US005240060A

United States Patent [19]

Blakely

[11] Patent Number: 5,240,060

[45] Date of Patent: Aug. 31, 1993

[54] ART WORK STRETCHER ASSEMBLY

[76] Inventor: John P. Blakely, 3691 Walnut Ave., Lynwood, Calif. 90262

[21] Appl. No.: 836,997

[22] Filed: Feb. 14, 1992

[51] Int. Cl.[5] ..... A47G 1/00

[52] U.S. Cl. ..... 160/377; 160/404; 38/102.9; 403/292

[58] Field of Search ..... 160/371, 377, 380, 404, 160/383; 40/152, 155; 403/292; 38/102.1, 102.2, 102.6, 102.9, 102.91

[56] References Cited

U.S. PATENT DOCUMENTS

| | | | |
|---|---|---|---|
| 517,860 | 4/1894 | Hooper . | |
| 1,056,966 | 3/1913 | Belding . | |
| 3,494,640 | 2/1970 | Coberly et al. | 403/292 X |
| 3,732,638 | 5/1973 | Hanley . | |
| 3,830,278 | 8/1974 | Packer . | |
| 3,885,333 | 5/1975 | Zachary . | |
| 3,906,647 | 9/1975 | Bates, Jr. . | |
| 4,128,356 | 12/1978 | Carlisle | 403/292 |
| 4,247,998 | 2/1981 | Foss | 38/102.2 |
| 4,441,267 | 4/1984 | Doss . | |
| 4,811,576 | 3/1989 | Davis . | |
| 4,993,611 | 2/1991 | Longo | 403/292 X |
| 5,079,860 | 1/1992 | Nugent | 403/292 X |

*Primary Examiner*—Blair M. Johnson
*Attorney, Agent, or Firm*—Pretty, Schroeder Brueggemann & Clark

[57] ABSTRACT

An art work stretcher assembly is disclosed having any desired arcuate, e.g., elliptical, shape. The stretcher assembly includes a plurality of plastic tubes that are flexed and arranged with their ends in abutment so as to provide a closed loop. A separate wooden dowel is inserted into each pair of abutting tube ends, to hold the tube ends together and to provide increased rigidity, and thus reduced curvature, in those regions of the closed loop. An elongated wooden strip is secured to the inwardly facing side of the closed loop of tubes, to provide a surface onto which can be fastened a planar art work substrate such as canvas.

8 Claims, 1 Drawing Sheet

ART WORK STRETCHER ASSEMBLY

BACKGROUND OF THE INVENTION

This invention relates generally to stretchers for canvas or other art work surfaces and, more particularly, to stretchers that have an arcuate, e.g., elliptical, periphery.

Artists have long chosen to create artistic renderings having elliptical or circular peripheries, to achieve a particular artistic effect. One popular means for providing the surface upon which to create such a rendering has been the use of an arcuately-formed wooden stretcher over which the artist's material is stretched and fastened. Unlike a rectangular wooden stretcher, which may be easily assembled from readily available wood board material cut to the desired lengths, an arcuate wooden stretcher has typically been produced by cutting flat wooden board material into the actual arcuate shape desired and by cutting out a similar shape of smaller dimension to yield a flat wooden ring over which the artist's material may be stretched and fastened. Such arcuate cutting of wood necessitates special preparation, such as preparing a template of the final shape for use as a guide in cutting the wood, as well as special tooling, such as a jigsaw to make a curved wood cut. Moreover, considerable time is required to make such an arcuate cut accurately, as well as to correct imperfections in the cut and perfect the final arcuate shape.

While mass production of such arcuate stretchers has made them an item generally available at art supply merchandisers, such mass production allows only a limited number of standardized shapes and sizes to be readily available at moderate cost. An artist desiring a non-standard size or shape either would need to construct such a stretcher, thus requiring special tools and painstaking accuracy, or would need to have such a stretcher custom built.

Artists often prefer to construct their own stretchers not only to control the stretcher's exact dimensions, but also to economize by the considerable savings in material costs in self-production of stretchers over the cost of ready made stretchers. Self-production of rectangular stretchers from raw materials, or from do-it-yourself kits consisting of precut boards that may be assembled in a variety of rectangular configurations, is easily accomplished because the only straight cuts are required to produce a rectangle. However, the artist desiring an arcuate stretcher typically would need to invest in both tooling and time.

It should be appreciated from the foregoing that there is need for an art work stretcher assembly adapted to provide a variety of arcuate shapes and dimensions, which can be assembled at lower cost by either a manufacturer, a retailer, or an individual end user, which can be customized to an individual artist's specifications with no special tooling or expertise required and with only limited labor required, and which can be shipped and stocked in component form, to be assembled by either the merchant or the end user. The present invention fulfills this need.

SUMMARY OF THE INVENTION

The present invention is embodied in an art work stretcher assembly for mounting an art work substrate material which is constructed of a plurality of flexible tubes joined together in a closed loop, with their ends in abutment, by dowels that serve the additional function of reducing the curvature of the formed loop to yield a predetermined arcuate shape of desired parameters. Each dowel projects a predetermined distance into the abutting ends of two tubes. The tubes are formed of a material having enough flexibility to conform to a desired curvature, yet enough rigidity to maintain its shape once formed and installed as part of the stretcher assembly.

The dowels are constructed of a material having predetermined rigidity such that, once inserted into the tubes, the degree of curvature of the tubes is reduced by a desired amount in the regions of dowel placement. The diameter of the dowels approximates the inside diameter of the tubes, so that dowels are held in place by friction, whereby each dowel securely fastens the two adjoining tubes.

In a more detailed feature of the invention, an elongated strip is attached along the radially-inward side of the closed loop, to provide a surface to which can be attached the planar art work substrate material. In use, the substrate material, e.g., canvas, is placed across one face of the stretcher, over the outside periphery, and over the other face to the inner periphery, where it is fastened to the strip with friction fasteners, such as staples or tacks.

Other aspects and advantages of the invention will become apparent from the following description of the preferred embodiment, taken in conjunction with the accompanying drawings, which illustrate by way of example, the principles of the invention.

DESCRIPTION OF THE PREFERRED EMBODIMENT

Figure 1:
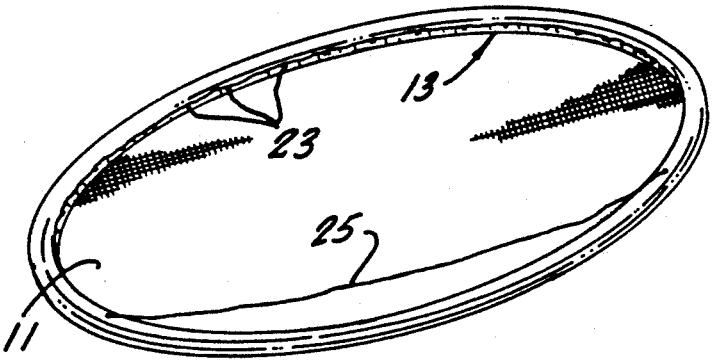
FIG. 1 is a rear perspective view of an arcuate art work stretcher assembly embodying the present invention, showing the attachment of a planar art work substrate material to the stretcher assembly.
Figure 2:
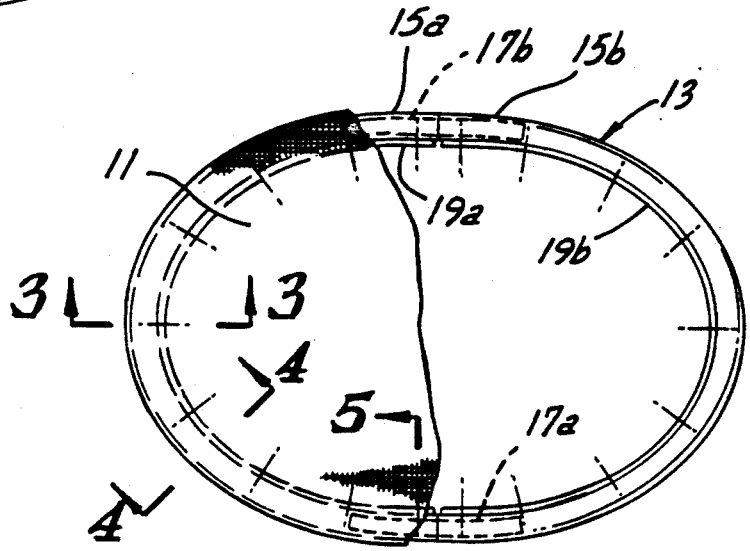
FIG. 2 is a front view of the stretcher assembly of FIG. 1, with a portion of the art work substrate material being cut away to reveal the elongated strips located along the inner periphery of the stretcher assembly's tubes.

With reference now to the exemplary drawings, there is shown a canvas art work substrate 11 mounted on an elliptically-shaped stretcher assembly 13 constructed in accordance with the invention. As best shown in FIG. 2, the stretcher assembly includes two plastic tubes **15*a* and 15*b***, of substantially equal length. The tubes are each bent through a 180° arc and arranged with their ends are in abutting relationship, to form a closed loop. Conveniently, the tubes can be formed of readily-available polyvinyl chloride.

The tubes 15*a* and 15*b* are maintained in the closed loop by two wooden dowels 17*a* and 17*b*, of substantially equal length, significantly shorter than the tubes. Each dowel projects a short distance into the open ends of two abutting tubes. The dowels are sized relative to the tubes such that a snug fit is provided and the dowels thereby are held in place by friction. The presence of the dowels increases the rigidity, or resistance to bending, of the portions of the tubes in which the dowels are located. Consequently, the tubes combine to form a generally elliptical or oval shape.

It will be appreciated that eccentricity of the stretcher assembly's elliptical shape will vary according to the relative lengths of the tubes 15*a* and 15*b* and dowels 17*a* and 17*b*. Increasing the lengths of the dowels relative to the lengths of the tubes will increase the proportion of the tubes having increased rigidity, thereby increasing the ellipse's eccentricity. Conversely, decreasing the lengths of the dowels relative to the lengths of the tubes will decrease the proportion of the tubes having increased rigidity and thereby decrease the ellipse's eccentricity.

It also will be appreciated that arcuate shapes other than ellipses can be provided by using different numbers of tubes and, correspondingly, dowels. For example, a rounded rectangular stretcher assembly (not shown in the drawings) could be provided by using four tubes and four dowels. Providing two of the dowels with lengths longer than the other two would enable control of the ratio of the assembly's height to width.

To facilitate the fastening of the canvas 11 to the stretcher assembly 13, the stretcher assembly further includes two elongated wooden strips 19*a* and 19*b*. The two strips have lengths substantially the same as the tubes 15*a* and 13*b*, and they are fastened to the tubes on the inwardly-facing side of the elliptical shape. Preferably, as shown in FIG. 2, each strip is arranged to be substantially co-extensive with a separate tube. The strips can be conveniently fastened in place using a plurality of screws 21. As shown in FIG. 2, nine such screws are provided for each strip and tube combination. To facilitate the fastening, pilot holes are preferably drilled in the strip and tube to facilitate the threading of each screw.

Figure 3:
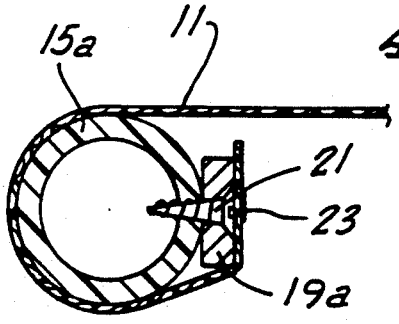
FIG. 3 is a cross-sectional view of the stretcher assembly taken substantially along the line 3—3 in FIG. 2, showing the fastening of an elongated strip to a tube.
Figure 4:
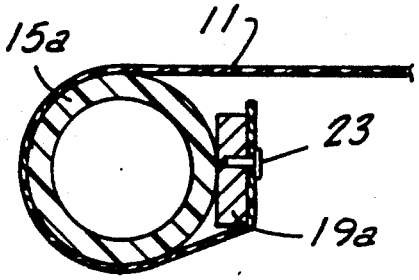
FIG. 4 is a cross-sectional view of the stretcher assembly, similar to FIG. 3, but taken substantially along the line 4—4 in FIG. 2, and showing the fastening of the stretched material to the elongated strip.
Figure 5:
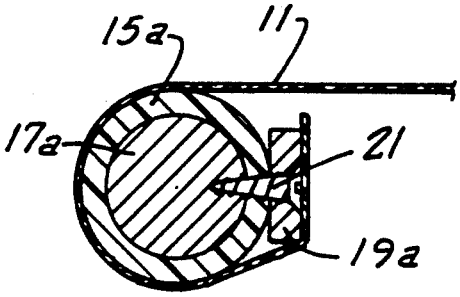
FIG. 5 is a cross-sectional view of the stretcher assembly, similar to FIGS. 3 and 4, but taken substantially along the line 5—5 in FIG. 2, and showing the fastening of the elongated strip to a tube at a location where a dowel has been inserted into the tube.

FIGS. 3 and 5 are both sectional views of the tube 15*a* and strip 19*a* combination in locations where screws 21 are present. It will be noted that the screw extends into the tube's hollow interior. The FIG. 5 view is taken at a section of the tube where the dowel 17*a* also is present. Consequently, the screw 21 extends through the tube and engages the dowel. This engagement further secures the dowel in place, supplementing the frictional engagement between the dowel and the tube.

The canvas 11 is secured to the stretcher assembly by wrapping it around the assembly's outer, elliptical periphery and then inwardly over the two elongated strips 19*a* and 19*b*. A large number of friction fasteners such as tacks 23 or the like then can be used to fasten the canvas to the strips. The tacks should have a length selected such that they do not project beyond the strips into engagement with the more impervious plastic tubes 15*a* or 15*b*.

Finally, a conventional wire hanger 25 can be attached to the rearward side of the final assembly, to facilitate mounting the final assembly on a wall.

It will be appreciated from the foregoing description that the present invention provides a significant advance in the design of arcuate-shaped art work stretcher assemblies. No templates or special tooling is needed to cut the desired arcuate shape is needed. Moreover, the stretcher assembly is constructed from low cost components, with minimal stocking space requirements, and the artist himself can assemble the stretcher assembly with minimal effort. Additional advantages of the invention are the stretcher assembly's light weight, a factor of particular importance in larger art works, and improved utility of raw materials, resulting in reduced waste in production.

Although the stretcher assembly of the invention has been described with reference to one preferred embodiment, it will be understood by those skilled in the art that modifications may be made that will still embody the spirit and scope of the invention. The invention is defined only by the following claims.

I claim:

1. A stretcher assembly for supporting a planar art work substrate material, comprising:

a plurality of flexible tubes arranged with their ends abutting each other to form a closed loop;

a plurality of dowels sized to fit snugly within the plurality of flexible tubes, each dowel projecting a predetermined distance into the abutting ends of two tubes, to attach the abutting tubes together and to provide the closed loop with sections of reduced curvature, such that a predetermined arcuate shape is appropriate; and a strip attached to the plurality of tubes along substantially the entire radially-inward side of the closed loop, to provide a surface for fastening the art work substrate to the stretcher assembly.

2. A stretcher assembly as recited in claim 1, wherein the strip is formed of wood.

3. A stretcher assembly as recited in claim 1, and further comprising:

a plurality of strips, each strip being coterminous with a separate tube; and a plurality of screws for attaching the plurality of strips to the tubes.

4. A stretcher assembly for supporting a planar art work substrate, comprising:

two flexible tubes of substantially equal length, formed of polyvinylchloride and arranged with their ends abutting each other to form a closed loop;

two wooden dowels of circular cross-section and substantially equal length projecting substantially equal distances into the ends of the two tubes such that the closed loop is provided with a generally elliptical shape; and two wooden strips of substantially the same length as the two flexible tubes, attached substantially coterminously to the tubes along the radially-inward side of the closed loop, to provide a surface for fastening the art work substrate to the stretcher assembly.

5. An art work assembly, comprising:

a plurality of flexible tubes arranged with their ends abutting each other to form a closed loop;

a plurality of dowels sized to fit snugly within the plurality of flexible tubes, each dowel projecting a predetermined distance into the abutting ends of two tubes, to attach the abutting tubes together and to provide the closed loop with sections of reduced curvature, such that a predetermined arcuate shape is provided; and an art work substrate secured to the closed loop and sized to form a generally planar, continuous surface having a perimeter defined by the closed loop.

6. An art work assembly as recited in claim 5, wherein the art work substrate is woven cloth.

7. An art work assembly as recited in claim 5, wherein the art work substrate is canvas.

8. An art work assembly as recited in claim 5, and further including a strip attached to the plurality of tubes along substantially the entire radially-inward side of the closed loop, to provide a surface for fastening the art work substrate.

* * * * *